US007465067B2

(12) United States Patent
Maes et al.

(10) Patent No.: US 7,465,067 B2
(45) Date of Patent: Dec. 16, 2008

(54) MOVING-HEAD DEVICE COMPRISING A LAMP

(75) Inventors: Wouter Jozef Maes, Turnhourt (BE); Mads Glavind, Hobro (DK)

(73) Assignee: Koninklijke Philips Electronics, N.V., Eindhoven (NL)

( * ) Notice: Subject to any disclaimer, the term of this patent is extended or adjusted under 35 U.S.C. 154(b) by 227 days.

(21) Appl. No.: 10/550,338

(22) PCT Filed: Mar. 22, 2004

(86) PCT No.: PCT/IB2004/050302

§ 371 (c)(1),
(2), (4) Date: Sep. 22, 2005

(87) PCT Pub. No.: WO2004/085919

PCT Pub. Date: Oct. 7, 2004

(65) Prior Publication Data

US 2006/0181876 A1 Aug. 17, 2006

(30) Foreign Application Priority Data

Mar. 27, 2003 (EP) ..... 03100800

(51) Int. Cl.
*F21V 21/28* (2006.01)

(52) U.S. Cl. ..... 362/275; 362/287; 362/419; 362/294

(58) Field of Classification Search ..... 362/269, 362/271, 272, 277, 282–286, 319, 418, 275, 362/287, 294, 297, 298, 301, 345, 346, 373, 362/419, 427, 428; 352/90; 353/87, 101
See application file for complete search history.

(56) References Cited

U.S. PATENT DOCUMENTS

| | | | | |
|---|---|---|---|---|
| 4,298,911 | A * | 11/1981 | Headrick | 362/272 |
| 4,777,568 | A | 10/1988 | Solomon | |
| 4,890,208 | A | 12/1989 | Izenour | |
| 5,590,955 | A * | 1/1997 | Bornhorst et al. | 362/324 |
| 5,816,690 | A | 10/1998 | Romano et al. | |
| 6,412,972 | B1 * | 7/2002 | Pujol et al. | 362/272 |

FOREIGN PATENT DOCUMENTS

| | | | |
|---|---|---|---|
| DE | 38 07 504 | A1 * | 9/1989 |
| DE | 3807504 | A1 | 9/1989 |
| EP | 0345030 | A2 | 12/1989 |
| EP | 0565904 | A1 | 10/1993 |
| EP | 0643257 | A | 3/1995 |
| GB | 2172122 | A | 9/1986 |
| JP | 04160702 | A | 6/1992 |

* cited by examiner

*Primary Examiner*—Bao Q Truong

(57) ABSTRACT

A moving-head device (1) comprises afoot (10) and ahead (20) that is movably arranged with respect to the foot (10). The head (20) comprises a first rotation member (21) that is rotatable with respect to the foot (10) about a first rotation axis (51), and a second rotation member (22) that is rotatable with respect to the first rotation member (21) about a second rotation axis (81). A lamp (61) is arranged inside the first rotation member (21), while directing means (62, 70, 75, 77, 78) are provided for directing light originating from the lamp (61) to an external light outlet (31). If the first rotation axis (51) extends in a vertical portion of the lamp (61) constituting an upper side (64) does not change during operation of the moving-head device (1), so that said portion may be easily cooled continuously.

27 Claims, 4 Drawing Sheets

MOVING-HEAD DEVICE COMPRISING A LAMP

Figure 1:
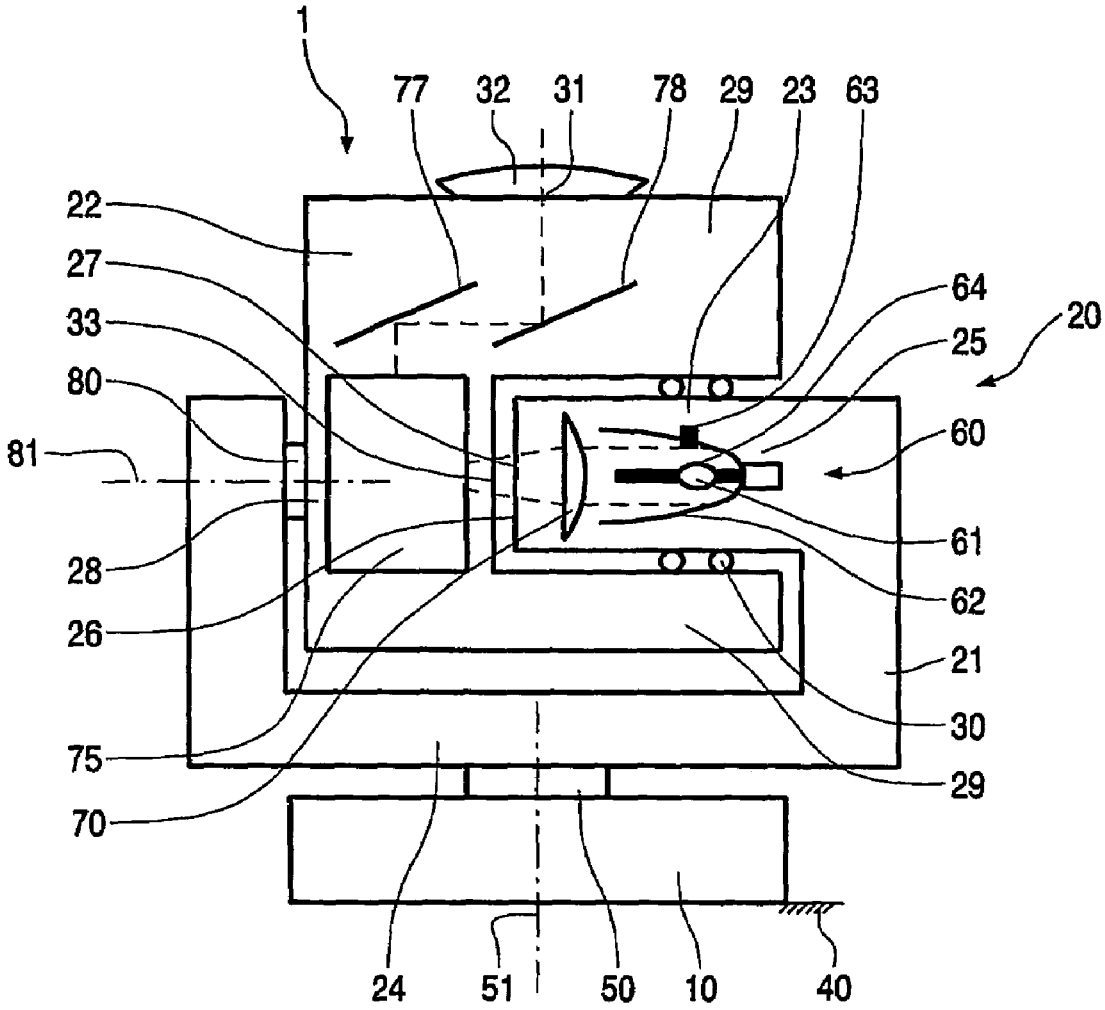

The present invention relates to a moving-head device comprising: a foot; a first rotation member which is rotatable with respect to the foot about a first rotation axis; a light source for emitting light; and a second rotation member which is rotatable with respect to the first rotation member about a second rotation axis and which has an external light outlet for emitting light originating from the light source.

Moving-head devices comprising a light source such as a lamp are well-known. Such moving-head devices are commonly used for the purpose of creating decorative light effects, for example during a pop concert or a road show, or in a discotheque. In such applications of the moving-head devices, it is required that the light effects have a dynamic appearance in order to create an atmosphere which harmonizes with the music. In order to meet this requirement, the external light outlet of the moving-head device is movably arranged, so that the direction in which the light is emitted is variable.

According to a well-known design of the moving-head device, the lamp is arranged in the second rotation member in a position opposite the external light outlet. The lamp is oriented such that light emitted during operation of the lamp is directed towards the external light outlet. The moving-head device often comprises a lens for converging the light and an analog unit or a digital unit for processing the light, which units are positioned in the path extending between the lamp and the external light outlet. Furthermore, a lens like a zoom lens or wash lens is positioned at the external light outlet.

The foot of the moving-head device is often fixedly connected to a carrier, for example a stage floor or a truss that is suspended above a stage. During operation of the moving-head device, the first rotation member performs a rotating movement with respect to the foot, about the first rotation axis. In many cases, the moving-head device is arranged such that the first rotation axis extends in a substantially vertical direction. Furthermore, the second rotation member performs a rotating movement with respect to the first rotation member about the second rotation axis. Normally, the second rotation axis is perpendicular to the first rotation axis. Therefore, in many cases, the second rotation axis extends in a substantially horizontal direction. As the second rotation member performs a rotating movement about the second rotation axis with respect to the first rotation member, and the first rotation member performs a rotating movement about the first rotation axis with respect to the foot, the second rotation member performs a combined rotating movement about both the first rotation axis and the second rotation axis with respect to the foot. The external light outlet is provided in the second rotation member, so the moving-head device is able to create a dynamic light effect when both the first rotation member and the second rotation member are rotated. Furthermore, the range of directions in which the light can be projected by the moving-head device is relatively large.

An important drawback of the moving-head devices according to the known design is that these devices can only be provided with lamps which are allowed to be moved in all possible directions. As a consequence, it is not possible to arrange certain kinds of lamps in the known moving-head device, more in particular lamps operating at a relatively high power, which will hereinafter be referred to as High Power Lamps or HP-lamps. HP-lamps may, for example, operate at a power higher than 300 W. During operation of an HP-lamp, an upper side of the lamp needs to be cooled continuously in order to prevent the lamp from getting too hot as a result of the high power. As the cooling process of the upper side of the lamp must not be interrupted, the position of the upper side of the lamp with respect to a device for performing the cooling process must not be varied. The position of the lamp itself with respect to the cooling device does not change during operation of the moving-head device, but the part of the lamp constituting the upper side changes continually.

Consequently, the cooling process is performed on a side of the lamp which does not need to be cooled most of the time, whereas the upper side is not cooled, and the lamp may become too hot. It will be understood that this may lead to dangerous situations, and that therefore the use of HP-lamps in moving-head devices is avoided.

It is an object of the present invention to provide a moving-head device suitable for receiving a HP-lamp, wherein the cooling process of the HP-lamp is not interrupted during operation of the moving-head device. This object is achieved by means of a moving-head device, wherein the light source is arranged in the first rotation member.

According to the present invention, the lamp of the moving-head device is rotatably arranged with respect to the foot of the moving-head device. An important difference between the design of the moving-head device according to the state of the art and the design of the moving-head device according to the present invention relates to the number of rotation axes about which the lamp is rotatable. According to the state of the art, the lamp is rotatable about both the first rotation axis and the second rotation axis, due to the fact that the lamp is arranged in the second rotation member, whereas according to the present invention, the lamp is only rotatable about the first rotation axis, as the lamp is arranged in the first rotation member.

A consequence of the fact that the lamp is arranged in the first rotation member is that the moving-head device according to the present invention is allowd to contain a HP-lamp, without the danger of the lamp getting too hot during operation of the moving-head device. After all, the moving-head device may be orientated such that the first rotation axis extends in a substantially vertical direction. In such an orientation of the moving-head device, the part of the lamp constituting the upper side of the lamp does not change during operation of the moving-head device. It is therefore possible to cool the part of the lamp constituting the upper side of the lamp continuously.

Normally the light originating from the lamp is directly aimed at the external light outlet of the second rotation member in the moving-head device according to the state of the art. This cannot be the case in many practical embodiments of the moving-head device according to the present invention, as the lamp is not ar ranged in the rotation member having the external light outlet. Instead, directing means such as mirrors are used to direct the light towards the external light outlet in such embodiments.

Figure 2:
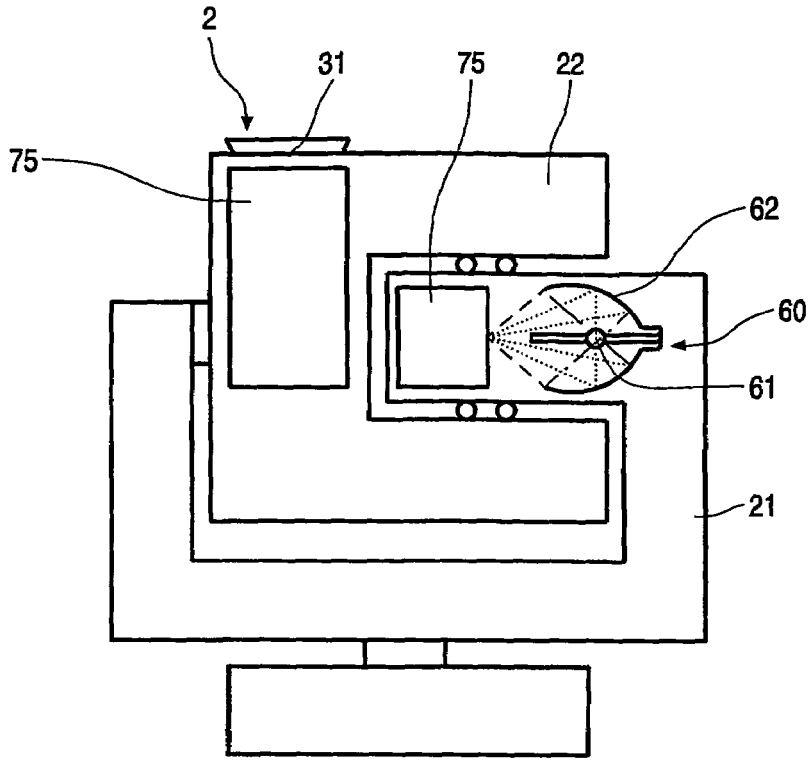
Figure 3:
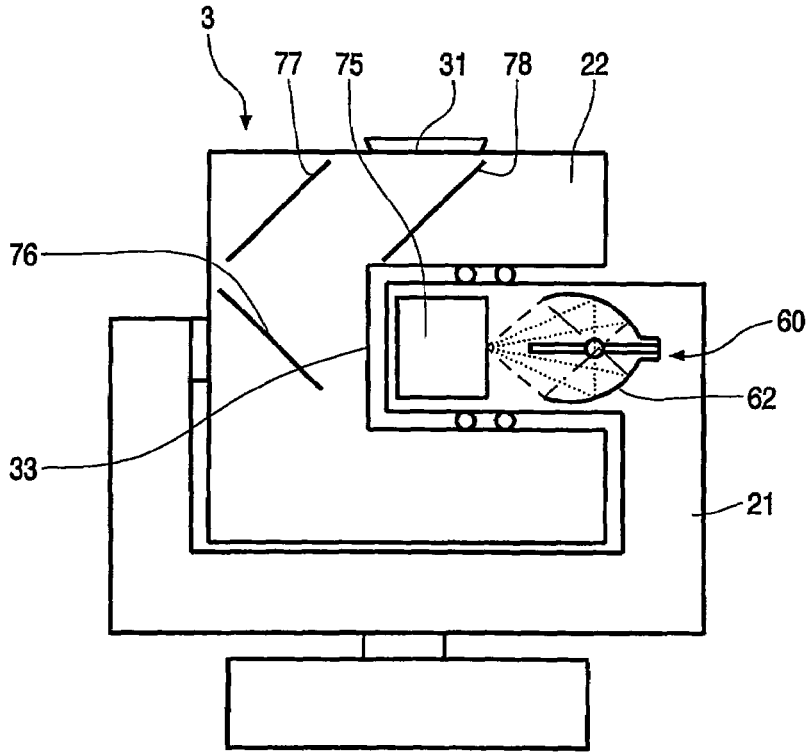
Figure 4:
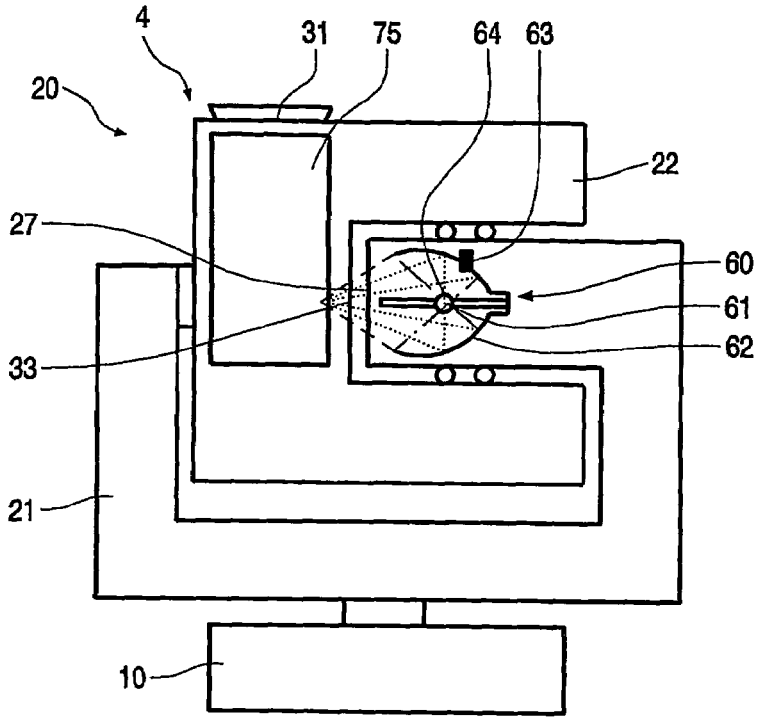
Figure 5:
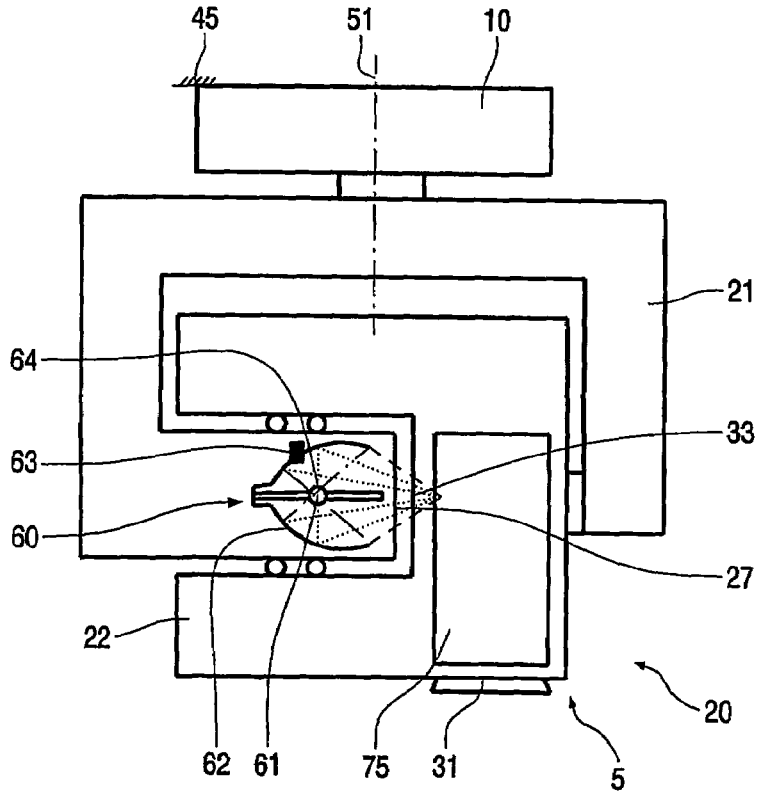
Figure 6:
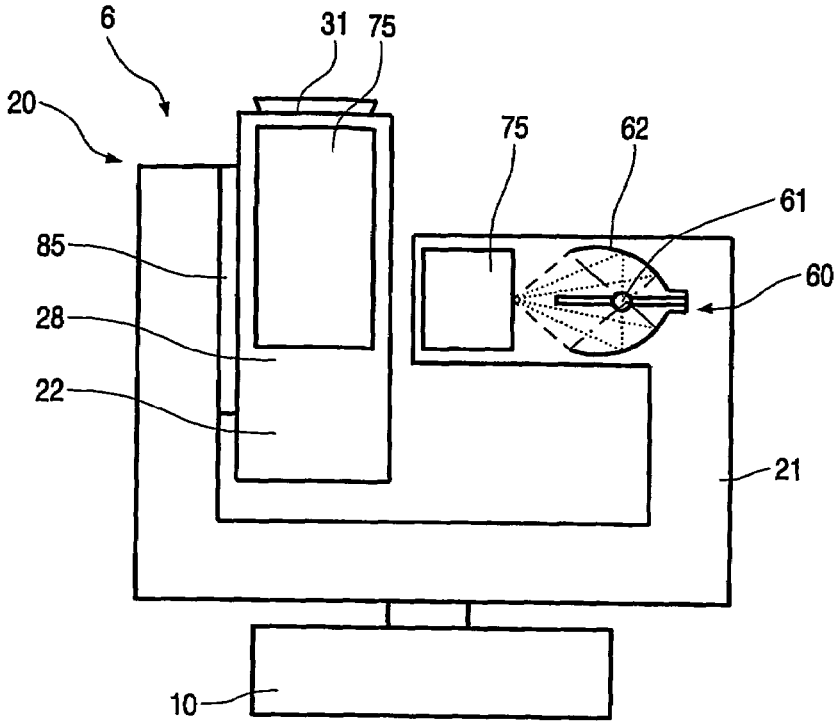
Figure 7:
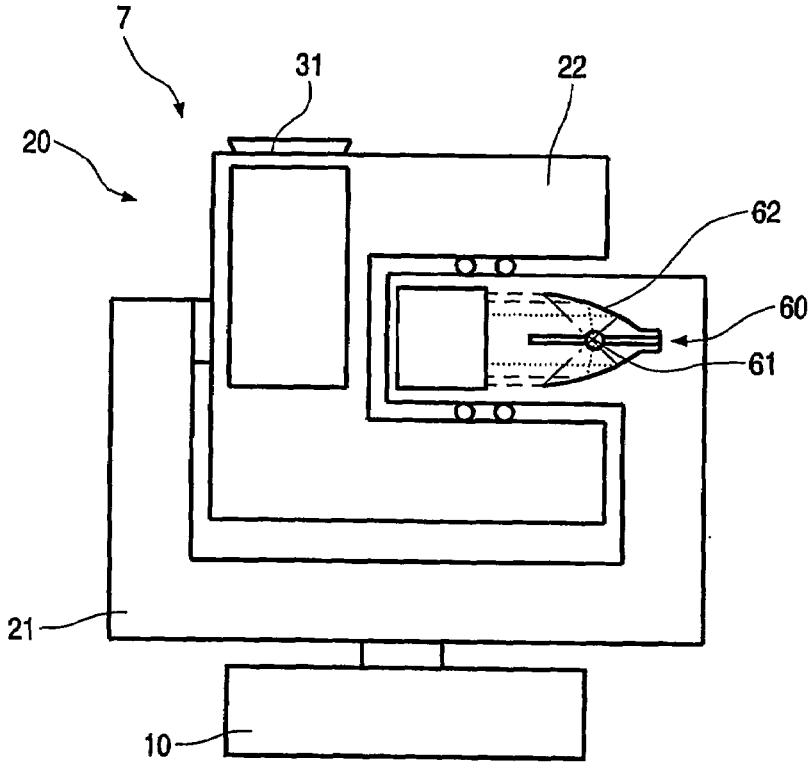

The present invention will now be explained in greater detail with reference to the Figures, in which similar parts are indicated by the same reference signs, and in which:

FIG. 1 diagrammatically shows a sectional view of a moving-head device according to a first preferred embodiment of the present invention, placed on a floor;

FIG. 2 diagrammatically shows a sectional view of a moving-head device according to a second preferred embodiment of the present invention, placed on a floor;

FIG. 3 diagrammatically shows a sectional view of a moving-head device according to a third preferred embodiment of the present invention, placed on a floor;

FIG. 4 diagrammatically shows a sectional view of a moving-head device according to a fourth preferred embodiment of the present invention, placed on a floor;

FIG. 5 diagrammatically shows a sectional view of a moving-head device according to a fifth preferred embodiment of the present invention, as being suspended from a ceiling;

FIG. 6 diagrammatically shows a sectional view of a moving-head device according to a sixth preferred embodiment of the present invention, placed on a floor; and FIG. 7 diagrammatically shows a sectional view of a moving-head device according to a seventh preferred embodiment of the present invention, placed on a floor.

FIG. 1 shows a first preferred embodiment of a moving-head device according to the present invention. In the Figure, the moving-head device according to this first preferred embodiment is referenced 1.

The moving-head device 1 comprises a foot 10 and a head 20, wherein the head 20 is movably arranged with respect to the foot 10. In the example as shown in FIG. 1, the moving-head device 1 is fixedly connected to a floor 40. As the head 20 should be able to move freely during operation of the moving-head device 1, the connection between the moving-head device 1 and the floor 40 is realized through the foot 10, in any suitable way, for example by means of screws or bolts.

In the following, the terms "up" and "under" and derived terms relate to an orientation of the moving-head device 1 as shown in FIG. 1, wherein the foot 10 is positioned at a lower side of the moving-head device 1, while the head 20 is positioned at an upper side of the moving-head device 1. It will be understood that this definition is arbitrary, as the moving-head device 1 may have a totally different orientation from the one shown in FIG. 1, for example an upside-down orientation as shown in FIG. 5. Furthermore, the terms "horizontal" and "vertical" relate to an orientation of the floor 40 as shown in FIG. 1, wherein it is assumed that the floor 40 extends in a horizontal plane, and gravity acts in a vertical direction perpendicular to said horizontal plane. Although the definitions relate to a usual orientation of the moving-head device 1, it should be understood that the definitions are not to be regarded as having a limiting effect on the scope of the present invention.

The head 20 comprises a first rotation member 21 and a second rotation member 22. The head 20 is connected to the foot 10 by means of a first spindle 50 extending in a substantially vertical direction. In the example shown, the first spindle 50 is fixedly connected to the first rotation member 21 and rotatable with respect to the foot 10 about its central axis 51. Consequently, the first rotation member 21 is rotatable with respect to the foot 10 about the central axis 51 of the first spindle 50, which will therefore be referred to hereinafter as the first rotation axis 51.

In the example shown, a cross-section of the first rotation member 21 is shaped as a hollow ring having a rectangular circumference from which a portion of one side 23 of the rectangular ring has been removed. The interrupted side 23 of the first rotation member 21 is positioned opposite a side 24 of the first rotation member 21 that is connected to the first spindle 50.

According to an important aspect of the present invention, a HP-lamp unit 60 is positioned inside the first rotation member 21. The HP-lamp unit 60 is located at the interrupted side 23 of the first rotation member 21. The portion of the interrupted side 23 containing the HP-lamp unit 60 will hereinafter be referred to as lamp holding portion 25. At a butt end 26 of the lamp holding portion 25, an internal light outlet 27 is provided in a wall of the first rotation member 21. The internal light outlet 27 may simply comprise a hole in the wall of the first rotation member 21.

The HP-lamp unit 60 comprises a HP-lamp 61 and a parabolic reflector 62 partially surrounding the HP-lamp 61. An inlet 63 is provided in a wall of the reflector 62 for admitting cooling air from a cooling device (not shown) to an upper side 64 of the Hplamp 61. The HP-lamp 61 may be, for example, an Ultra High Performance lamp (UHP-lamp), which is operable at a relatively high power.

A lens unit 70 is arranged between the HP-lamp unit 60 and the internal light outlet 27. The HP-lamp unit 60 and the lens unit 70 are oriented and arranged such that light originating from the HP-lamp 61 is directed to the lens unit 70 by the reflector 62. Furthermore, the light that passes the lens unit 70 is directed to the internal light outlet 27, wherein the light is converged by the lens unit 70.

In the example shown, a cross-section of the second rotation member 22 is Ushaped, while the second rotation member 22 is hollow. A base portion 28 of the U-shaped second rotation member 22 is connected to the first rotation member 21 by means of a second spindle 80, such that leg portions 29 of the second rotation member 22 encompass the lamp hol ding portion 25 of the first rotation member 21. Furthermore, a roller bearing 30 is provided between the lamp holding portion 25 of the first rotation member 21 and the leg portions 29 of the second rotation member 22.

The second spindle 80 extends between the base portion 28 of the second rotation member 22 and a portion of the first rotation member 21 opposite the internal light outlet 27 in the lamp holding portion 25, in a substantially horizontal direction. In the example shown, the second spindle 80 is fixedly connected to the second rotation member 22 and rotatable with respect to the first rotation member about its central axis 81. Consequently, the second rotation member 22 is rotatable with respect to the first rotation member 21 about the central axis 81 of the second spindle 80, which will therefore be referred to hereinafter as the 5 second rotation axis 81.

An external light outlet 31 is provided at an upper side of the second rotation member 22. The external light outlet 31 may simply comprise a hole in a wall of the second rotation member 22. At the outside of the second rotation member 22, the external light outlet 31 is covered by a cap 32, which preferably comprises a lens such as a zoom lens or wash lens (not shown).

A light inlet 33 is provided at the base portion 28 of the second rotation member 22 for admitting light that shines through the internal light outlet 27 of the first rotation member 21. In the design of the moving-head device 1 shown here, the internal light outlet 27 and the light inlet 33 face each other in every possible position of the second rotation member 22 with respect to the first rotation member 21. The light inlet 33 may simply comprise a hole in the wall of the second rotation member 22.

A processing unit 75 for processing the light is arranged inside the second rotation member 22. In the example shown, the processing unit 75 is positioned right behind the light inlet 33, so that light shining through the internal light outlet 27 of the first rotation means 21 directly reaches the processing unit 75 through the light inlet 33 of the second rotation member 22. The processing unit 75 is capable inter alia of changing the direction of the light. In the example shown in FIG. 1, light emitted by the processing unit 75 radiates substantially in the same direction as the base portion 28 of the second rotation member 22.

Besides the processing unit 75, a first mirror 77 and a second mirror 78 are arranged inside the second rotation member. The mirrors 77, 78 play a role in directing the light shining from the processing unit 75 to the external light outlet 31. Light that leaves the processing unit 75 is reflected by the first mirror 77 in the direction of the second mirror 78, which second mirror 78 reflects the light in the direction of the external light outlet 31.

It will be understood that the positions and orientations of the mirrors 77, 78 are adjusted so as to perform the task of guiding the light towards the external light outlet 31.

It will be understood that the moving-head device 1 may comprise more components which are commonly used in moving-head devices than the components shown in FIG. 1, for example an infrared filter that is positioned between the HP-lamp unit 60 and the lens unit 70.

The lamp accommodated in the first rotation member 21 does not necessarily need to be a HP-lamp 61; the moving-head device 1 according to the present invention may equally well contain some other suitable lamp. However, the use of a HP-lamp 61 is regarded as an interesting option because the light output of the moving-head device 1 may be relatively high in this case.

During operation of the moving-head device 1, the HP-lamp 61 and the cooling device are switched on. Furthermore, the spindles 50, 80 are rotated, as a result of which the first rotation member 21 is rotated with respect to the foot 10 about the first rotation axis 51 and the second rotation member 22 is rotated with respect to the first rotation member 21 about the second rotation axis 81. Each of the spindles 50, 80 may be driven, for example, by an associated motor (not shown).

There are numerous possibilities for the way in which the rotation members 21, 22 may be moved. According to a usual possibility, the first rotation member 21 is rotated in one rotational direction about the first rotation axis 51 at a constant speed, whereas the second rotation member 22 performs a reciprocating motion about the second rotation axis 81. It will be understood that, although the moving-head device 1 is designed for shining light in varying directions, it may alternatively be applied for directing light in a fixed direction. For the purpose of such an application, the head 20 has a fixed position with respect to the foot 10 and the rotation members 21, 22 do not move.

As the HP-lamp 61 is arranged inside the first rotation member 21, and the first rotation member 21 is only rotatable about the first rotation axis 51 with respect to the foot 10, the upper side 64 of the HP-lamp 61 continuously faces upwards, i.e. away from the foot 10 and the floor 40. The mutual positions of the inlet 63 in the reflector 62 and the upper side 64 of the HP-lamp 61 are maintained, as a result of which the cooling process of the upper side 64 of the HP-lamp 61 takes place continuously.

In FIG. 1, the course followed by the light is diagrammatically indicated by means of dotted lines. The light emitted by the HP-lamp 61 is directed at the lens unit 70 by the reflector 62. The light is converged by the lens unit 70 and is received by the processing unit 75 after having passed the internal light outlet 27 and the light inlet 33. During movements of the first rotation member 21 and/or the second rotation member 22, the mutual positions of the internal light outlet 27 and the light inlet 33 are not changed, as the second rotation axis 81 about which the movement is performed extends through both the internal light outlet 27 and the light inlet 33.

The light is subjected to at least one treatment in the processing unit 75. The processing unit 75 may comprise, for example, an LCD-chip, a DLP-chip, at least one mirror, a colour changer, a color splitter and/or a special effects pattern device such as a gobo for the purpose of treating the light. It will be understood that many possibilities exist for the design of the processing unit 75 within the scope of the present invention. In the example shown, the processing unit 75 is designed to at least change the direction of the light.

The first mirror 77 is positioned in the path of the light coming from the processing unit 75. The first mirror 77 is positioned such that it reflects the light in a substantially horizontal direction towards the second mirror 78, which is positioned such that it reflects the light in the direction of the external light outlet 31. In act, both mirrors 77, 78 are positioned such that an angle between received light and reflected light is substantially 90°. Consequently, an angle between the mirror 77, 78 and received light on the one hand is 45°, whereas an angle between the mirror 77, 78 and reflected light on the other hand is also 45°.

Light originating from the HP-lamp 61 always follows the above-described path. Thus, the moving-head device 1 will always emit light through the external light outlet 31 as long as the HP-lamp is switched on. The course of the light emitted by the moving-head device 1 may be influenced by a possible zoom lens or wash lens in the cap 32 covering the external light outlet 31.

Alternative embodiments of the moving-head device according to the present invention are shown in FIGS. 2-7. It will be understood that the Figures only show a selection from the many possible embodiments of the moving-head device according to the present invention.

All embodiments shown comprise a foot 10, a head 20 having a first rotation member 21 and a second rotation member 22, and a HP-lamp 61. According to an important aspect of the present invention, the HP-lamp 61 is arranged inside the first rotation member 21, and the external light outlet 31 is located at the second rotation member 22.

FIG. 2 shows a second preferred embodiment of a moving-head device according to the present invention. In the Figure, the moving-head device according to this second preferred embodiment is given the general reference numeral 2.

An important difference between the moving-head device 2 according to the second preferred embodiment and the above-described moving-head device 1 according to the first preferred embodiment relates to the means for processing the light originating from the HP-lamp 61 and directing the light from the HP-lamp 61 to the external light outlet 31.

The moving-head device 2 comprises a HP-lamp unit 60 having an elliptical reflector 62. As the light emitted by the HP-lamp 61 is converged by the elliptical reflector 62, there is no need for a lens unit 70.

Furthermore, the moving-head device 2 comprises two processing units 75, one of the processing units 75 being arranged inside the first rotation member 21 and another one of the processing units 75 being arranged inside the second rotation member 22. In the second rotation member 22, the external light outlet 31 is positioned right in front of the processing unit 75, so that there is no need for mirrors or other means to direct the light coming from the processing unit 75 to the external light outlet 31.

FIG. 3 shows a third preferred embodiment of a moving-head device according to the present invention. In the Figure, the moving-head device according to this third preferred embodiment is given the general reference numeral 3.

In common with the moving-head device 2 according to the second preferred embodiment, the moving-head device 3 according to the third preferred embodiment comprises a HP-lamp unit 60 having an elliptical reflector 62 and a processing unit 75 arranged inside the first rotation member 21.

Furthermore, the moving-head device 3 comprises three mirrors 76, 77, 78 that are arranged inside the second rotation member 22 for directing the light to the external light outlet 31. A first mirror 76 is arranged behind the light inlet 33 for receiving light coming from the processing unit 75 in the first rotation member 21. The first mirror 76 is positioned so as to reflect the light in the direction of a second mirror 77. The second mirror 77 is positioned so as to reflect the light in the direction of a third mirror 78, which is positioned so as to reflect the light in the direction of the external light outlet 31.

FIG. 4 shows a fourth preferred embodiment of a moving-head device according to the present invention. In the Figure, the moving-head device according to this fourth preferred embodiment is given the general reference numeral 4.

In common with the moving-head devices 2 and 3 according to the second and third preferred embodiments, the moving-head device 4 according to the fourth preferred embodiment comprises a HP-lamp unit 60 having an elliptical reflector 62.

Furthermore, the moving-head device 4 comprises a processing unit 75 arranged inside the second rotation member 22 for processing the light originating from the HP-lamp 61 and for directing the light to the external light outlet 31. The processing unit 75 is positioned right behind the light inlet 33, so that light shining through the internal light outlet 27 of the first rotation means 21 directly reaches the processing unit 75 through the light inlet 33 of the second rotation member 22. The processing unit 75 is capable inter alia of changing the direction of the light. The external light outlet 31 is positioned right in front of the processing unit 75, so that there is no need for mirrors or other means to direct the light coming from the processing unit 75 to the external light outlet 31.

The HP-lamp unit 60 is positioned right behind the internal light outlet 27 in the first rotation member 21 of the moving-head device 4, and no other components are arranged between the lamp 61 and the internal light outlet 27. The light is thus sent directly from the lamp 61 in the first rotation member 21 to the processing unit 75 in the second rotation member 22 during operation of the moving-head device 4.

FIG. 5 shows a fifth preferred embodiment of a moving-head device according to the present invention. In the Figure, the moving-head device according to this fifth preferred embodiment is given the general reference numeral 5.

The design of the moving-head device 5 according to the fifth embodiment resembles the design of the moving-head device 4 according to the fourth embodiment. A difference between said moving-head devices 4, 5 lies in the orientation of the moving-head devices 4, 5. The moving-head device 4 is designed to be oriented such that the head 20 is up, whereas the moving-head device 5 is designed to be oriented such that the foot 10 is up. FIG. 5 illustrates this upside-down orientation of the moving-head device 5, wherein the moving-head device 5 is shown suspended from a ceiling 45.

In common with the orientation of the moving-head device 4 as shown in FIG. 4, the first rotation axis 51 extends in a substantially vertical direction in the upside-down orientation of the moving-head device 5 as shown in FIG. 5, so that the upper side 64 of the HP-lamp 61 continuously faces upwards, i.e. towards the ceiling 45. In the same way as described in relation to the moving-head device 1 according to the first preferred embodiment, the necessary cooling process of the HP-lamp 61 can take place continuously.

Compared with the moving-head device 4 according to the fourth embodiment, the position of the inlet 63 for cooling air is different, as the upper side 64 of the HP-lamp 61 occupies a different position with respect to the other components of the moving-head device 5. The inlet 63 in the moving-head device 5 according to the fifth embodiment is positioned at a side of the HP-lamp 61 directed at the foot 10, whereas the inlet 63 is positioned at an opposite side of the HP-lamp 61 in the moving-head device 4 according to the fourth preferred embodiment.

FIG. 6 shows a sixth preferred embodiment of a moving-head device according to the present invention. In the Figure, the moving-head device according to this sixth preferred embodiment is given the general reference numeral 6.

In common with the moving-head device 2 according to the second preferred embodiment, the moving-head device 6 according to the sixth preferred embodiment comprises a HP-lamp unit 60 having an elliptical reflector 62, and two processing units 75, one of the processing units 75 being arranged inside the first rotation member 21 and another one of the processing units 75 being arranged inside the second rotation member 22.

An important difference between the moving-head device 6 according to the sixth preferred embodiment and the other moving-head devices 1, 2, 3, 4, 5 shown lies in the shape and suspension of the second rotation member 22. Unlike the second rotation members 22 of the other moving-head devices 1, 2, 3, 4, 5, the second rotation member 22 of the moving-head device 6 according to the sixth preferred embodiment only comprises the base portion 28, the leg portions 29 being omitted. The second rotation member 22 is rotatably connected to the first rotation member 21 by means of a disc 85 having a relatively large diameter, and no further means are provided to support the second rotation member 22.

FIG. 7 shows a seventh preferred embodiment of a moving-head device according to the present invention. In the Figure, the moving-head device according to this seventh preferred embodiment is given the general reference numeral 7.

The moving-head device 7 according to the seventh preferred embodiment resembles the moving-head device 2 according to the second preferred embodiment, with the exception of the shape of the reflector 62 of the HP-lamp unit 60, which is parabolic instead of elliptical.

Interpreting the above alternatives, it will be understood that processing of the light may take place in either or both of the two rotation members 21 and 22. It is not necessary within the scope of the present invention that the moving-head device 1, 2, 3, 4, 5, 6, 7 is provided with a processing unit 75. The moving-head device 1,2, 3, 4, 5, 6, 7 may comprise, for example, only one mirror arranged inside the second rotation member 22 for reflecting the light originating from the HP-lamp 61 in the direct ion of the external light outlet 31.

The moving-head device 1, 2, 3, 4, 5, 6, 7 may have any orientation. In the case of the moving-head device 1, 2, 3, 4, 5, 6, 7 comprising a lamp which is not allowed to be moved in all possible directions, for example a HP-lamp 61 which needs to be continuously cooled, the moving-head device 1, 2, 3, 4, 5, 6, 7 may be orientated upright or upside-down.

As was noted above, an important advantage of the design of the moving-head device 1, 2, 3, 4, 5, 6, 7 according to the present invention is that a HP-lamp 61 can be positioned in the head 20.

According to the state of the art, for example as described in GB 2 172 122, solutions for providing a moving-head device with a lamp which is not operable in all directions do exist, but these solutions comprise positioning the lamp in the foot of the moving-head device. Two important advantages over these known moving-head devices are provided by the moving-head device 1, 2, 3, 4, 5, 6, 7 according to the present invention. In the first place, according to the present invention, the design of the foot 10 does not need to be changed with respect to known moving-head devices in which the lamp 61 is positioned inside the second rotation member 22. As a result, it is possible to replace an existing moving-head device with a moving-head device 1,2, 3, 4, 5, 6, 7 according to the present invention simply by replacing the head 20 of the moving-head device. In such a case, it is not necessary to detach the foot 10 from a carrier such as a stage floor or a truss. In the second place, the lamp 61 and the directing means such as lens units 70, processing units 75, and mirrors 76, 77, 78 can be aligned more accurately, as these components of the moving-head device 1, 2, 3, 4, 5, 6, 7 are distributed over two separate members only, i.e. the rotation members 21, 22.

It will be clear to those skilled in the art that the scope of the present invention is not limited to the examples discussed above, but that several amendments and modifications thereof are possible without deviating from the scope of the present invention as defined in the attached claims.

For example, the foot 10 and the rotation members 21, 22 may be shaped differently from what is shown in FIGS. 1-7, wherein the rotation members 21, 22 may be partially hollow. Furthermore, the rotation axes 51, 81 do not necessarily need to be mutually perpendicular. The spindles 50, 80 may be fixedly connected to the first rotation member 21 and the second rotation member 22, respectively, but may as well be fixedly connected to the foot 10 and the first rotation member 21, respectively.

The reflectors 62 shown are parabolic or elliptical, which does not imply that the reflector 62 cannot have another suitable shape. The reflector 62 may be, for example, spherical.

A moving-head device 1, 2, 3, 4, 5, 6, 7 comprising a foot 10 and a head 20 that is movably arranged with respect to the foot 10 was described above.

The head 20 comprises a first rotation member 21 that is rotatable with respect to the foot 10 about a first rotation axis 51, and a second rotation member 22 that is rotatable with respect to the first rotation member 21 about a second rotation axis 81.

A "High Power" lamp 61 is arranged inside the first rotation member 21, while directing means 62, 70, 75, 76, 77, 78 are provided for directing light originating from the light source 61 to an external light outlet 31 in the second rotation member 22. If the moving-head device 1, 2, 3, 4, 5, 6, 7 is oriented such that the first rotation axis 51 extends in a substantially vertical direction, a portion of the HP-lamp 61 constituting an upper side 64 of the HP-lamp 61 does not change during operation of the moving-head device 1, 2, 3, 4, 5, 6, 7, as a result of which said portion may be easily cooled continuously.

The invention claimed is:

1. Moving-head device (1, 2, 3, 4, 5, 6, 7), comprising:

a foot (10);

a first rotation member (21) which is rotatable with respect to the foot (10) about a first rotation axis (51);

a light source (61) for emitting light, which is arranged in the first rotation member (21); and a second rotation member (22) which is rotatable with respect to the first rotation member (21) about a second rotation axis (81) and which has an external light outlet (31) for emitting light originating from the light source (61).

2. The moving-head device (1, 2, 3, 4, 5, 6, 7) according to claim 1, comprising directing means (62, 70, 75, 76, 77, 78) for directing light originating from the light source (61) to the external light outlet (31).

3. The moving-head device (1, 2, 3, 4, 5, 7) according to claim 1, wherein at least a portion (29) of the second rotation member (22) encompasses at least a portion (25) of the first rotation member (21).

4. The moving-head device (1, 2, 3, 4, 5, 7) according to claim 3, comprising bearing means (30) arranged between the portions (25, 29) of the rotation members (21, 22).

5. The moving-head device (1, 2, 3,4, 5, 6, 7) according to claim 1, wherein the first rotation member (21) has an internal light outlet (27), and wherein the second rotation member (22) has a light inlet (33) facing the internal light outlet (27).

6. The moving-head device (6) according to claim 1, wherein the second rotation member (22) is rotatably connected to the first rotation member (21) through a disc (85) which is fixed with respect to one of the rotation members (21, 22) and which is rotatable with respect to another one of the rotation members (21, 22).

7. The moving-head device (1, 2, 3, 4, 5, 6, 7) according to claim 1, comprising a reflector (62) partially surrounding the light source (61).

8. The moving-head device (1, 2, 3, 4, 5, 6, 7) according to claim 7, comprising a cooling device for cooling at least one side (64) of the light source (61), wherein the cooling device is arranged so as to provide cooling air to the light source (61), and wherein the reflector (62) is provided with an inlet (63) for admitting the cooling air.

9. The moving-head device (1, 2, 3, 4, 5, 6, 7) according to claim 1, wherein the light source comprises a High Power lamp (61).

10. The moving-head device (1) according to claim 1, comprising a lens unit (70) for converging light originating from the light source (61), the lens unit (70) preferably being arranged in the first rotation member (21).

11. The moving-head device (1, 2, 3, 4, 5, 6, 7) according to claim 1, comprising at least one processing unit (75) for processing light originating from the light source (61).

12. The moving-head device (1, 3) according to claim 1, comprising at least one mirror (76, 77, 78) for changing the direction of light originating from the light source (61) by reflecting the light.

13. The moving-head device (1, 2, 3, 4, 5, 6, 7) according to claim 1, wherein the rotation axes (51,81) are substantially perpendicular to each other.

14. Head (20) for a moving-head device (1, 2, 3, 4, 5, 6, 7), comprising:

a first rotation member (21) designed to be rotatably connected to a foot (10), such that the first rotation member (21) is rotatable with respect to the foot (10) about a first rotation axis (51);

a light source (61) for emitting light, which is arranged in the first rotation member (21); and a second rotation member (22) which is rotatable with respect to the first rotation member (21) about a second rotation axis (81) and which has an external light outlet (31) for emitting light originating from the light source (61).

15. The head (20) according to claim 14, comprising directing means (62, 70, 75, 76, 77, 78) for directing light originating from the light source (61) to the external light outlet (31).

16. The head (20) according to claim 14, wherein at least a portion (29) of the 10 second rotation member (22) encompasses at least a portion (25) of the first rotation member (21), and wherein bearing means (30) are preferably arranged between the portions (25, 29) of the rotation members (21, 22).

17. The head (20) according to claim 14, wherein the first rotation member (21) has an internal light outlet (27), and wherein the second rotation member (22) has a light inlet (33) facing the internal light outlet (27).

18. The head (20) according to claim 14, comprising a reflector (62) partially surrounding the light source (61).

19. The head (20) according to claim 14, comprising a cooling device for cooling at least one side (64) of the light source (61).

20. The head according to claim 14, wherein the light source comprises a High Power lamp (61).

21. Apparatus, comprising a first rotation member comprising a first housing;

a first rotation mechanism, at an exterior of the first housing, via which the first rotation member is rotatable with respect to a foot about a first rotation axis; and a light source disposed within the first housing; and a second rotation member comprising a second housing;

a second rotation mechanism, at an exterior of the second housing, via which the second rotation member is rotatable with respect to the first rotation member about a second rotation axis;

means for receiving and directing light from the light source; and a light outlet at the exterior of the second housing for emitting light originating from the light source.

22. The apparatus of claim 21, wherein the first housing forms a concavity and the first and second housings are adapted to rotate so that at least a portion of the second housing is movable within the concavity in the first housing.

23. The apparatus of claim 21, wherein the second housing forms a concavity and the first and second housings are adapted so that at least a portion of the first housing is movable within the concavity in the second housing.

24. The apparatus of claim 21, wherein the first and second housings each form respective concavities and the first and second housings are both adapted so that each has a portion that is movable within the concavity of the other.

25. The apparatus of claim 21, wherein the first housing is adapted to rest on top of the foot.

26. The apparatus of claim 21, wherein the first housing is adapted to be suspended from the foot.

27. The apparatus of claim 21, wherein the light source comprises a reflector that defines a beam direction that is substantially horizontal;

the first housing comprises cooling means adapted to cool an upper part of the reflector; and the first rotation axis is vertical, so that the cooling means always cools the upper part of the reflector without adjustment responsive to rotation.

* * * * *